United States Patent [19]

Canta et al.

[11] Patent Number: 4,582,038

[45] Date of Patent: Apr. 15, 1986

[54] METHOD AND DEVICE FOR AUTOMATICALLY CORRECTING THE AIR/FUEL RATIO IN AN ENDOTHERMIC RECIPROCATING ENGINE

[75] Inventors: Carlo Canta, Turin; Walter Mortara, Rivalta; Armando Borgetti, Turin, all of Italy

[73] Assignee: Fiat Auto S.p.A., Italy

[21] Appl. No.: 699,884

[22] Filed: Feb. 8, 1985

[30] Foreign Application Priority Data

Feb. 8, 1984 [IT] Italy ..... 67114 A/84

[51] Int. Cl.[4] ..... F02B 3/00

[52] U.S. Cl. ..... 123/494; 123/480; 123/436; 123/419

[58] Field of Search ..... 123/480, 436, 419, 494, 123/478; 73/DIG. 1

[56] References Cited

U.S. PATENT DOCUMENTS 4,377,145 3/1983 Nagaishi ..... 123/494

4,513,721 4/1985 Ina ..... 123/436

4,527,523 7/1985 Daumer ..... 123/436

*Primary Examiner*—Ronald B. Cox

*Attorney, Agent, or Firm*—Sughrue, Mion, Zinn, Macpeak, and Seas

[57] ABSTRACT

A method is described for monitoring the air/fuel ratio in an internal combustion engine by means of the measurement of pressure variations in the induction duct of the engine and for indicating appropriate changes in the fuel supply, in a closed loop, to return the ratio to the desired value. This method is achieved by means of a device which is characterized in that it includes a pressure sensor, means for processing the signal obtained from the sensor and a microcomputer for checking whether or not the values processed by said means fall within a predetermined, previously stored range found experimentally on a test engine under proper combustion conditions. If the processed values are outside this range, the microcomputer activates an alarm signal and/or operates, directly or indirectly a device which adjusts the air/fuel ratio to return it to normal values.

4 Claims, 2 Drawing Figures

METHOD AND DEVICE FOR AUTOMATICALLY CORRECTING THE AIR/FUEL RATIO IN AN ENDOTHERMIC RECIPROCATING ENGINE

DESCRIPTION

The present invention relates to a method and to a device for monitoring the air-fuel ratio in internal combustion engines and to apparatus for controlling this ratio.

The detection of anomalies in this ratio is for the most part effected by the user with emperical and subjective systems linked to the sensitivity of the driver and the correction of such anomalies occurs, in most cases, through manual adjustment by skilled personnel.

A publication of Centro Ricerche Fiat (SAE Technical Paper Series no. 830498 of 28/3/83) relating to accelerometer devices arranged to signal the said anomalies through a measurement of the lateral movement of the engine is known; these devices may at present be applied only to test bench engines since the vehicle on the road is subject to oscillations which would falsify the reliability of such measurements.

Other systems used are based on the detection of the fuel dispersion and particularly the detection of the pressure cycle in the combustion chamber by pressure sensors suitably arranged in the combustion chamber.

Even this method is difficult to apply industrially since the sensor is expensive and its mounting in the combustion chamber requires difficult machining if the system is to be reliable in the long term and is thus uneconomic.

Programmed microprocessor systems are known for ensuring the maintenance of the air/fuel ratio within the stoichiometric value on the basis of an on-off signal provided by a sensor, normally of the zirconium dioxide and titanium dioxide type. Such systems are widely used in order to reduce the polluting emissions drastically by the use of trivalent catalytic silencers which operate precisely under conditions of maximum efficiency when the metering is kept within a strict window about the stoichiometric value. These systems do not, however, allow the adjustment of the metering within the lean mixture field in that the sensor is only able to recognise a chemical variation which occurs close to stoichiometric conditions.

Under lean mixture conditions the sensor does not have sufficient sensitivity to provide a reliable detection of the air/fuel ratio.

The object of the present invention is to provide a method and a device for effecting control of the air/fuel ratio in an internal combustion engine and for monitoring and self-correcting the ratio when there are mixtures with anomalous values.

In particular, the device is adapted to provide a signal substantially proportional to the air/fuel ratio in the control of lean mixtures (with air/fuel ratio greater than 16) in that under these conditions (lean mixtures) the air/fuel ratio variations result in significant perturbations in the cyclic dispersion and hence in the smoothness of running of the engine itself. These perturbations in the cyclic dispersion in their turn induce pressure variations in the induction manifold of a degree proportional to the variations in the air/fuel ratio.

The said object is achieved by the present invention in that it relates to a method for monitoring the presence of anomalous combustion phenomena and hence, indirectly, variations in the air/fuel ratio, characterized in that it comprises the following steps:

- measuring the air pressure in the induction duct while the engine is running,
- processing the pressure signal in order to determine variations from one cycle to the next induced by anomalous combustion phenomena,
- storing a predetermined value, corresponding to an optimum running valve,
- indicating the presence of anomalous phenomena in the air/fuel ratio when the value corresponding to the pressure variation measured departs from the stored value, and
- correcting the air/fuel ratio.

The invention also relates to a device for carrying out the method described above for the continuous control of the exact air/fuel ratio in an endothermic engine, characterised in that it comprises:

- a pressure sensor located suitably in the engine induction duct,
- a signal amplifier for amplifying the signal,
- a band-pass filter and a low-pass filter arranged to select a suitable frequency range of the signal,
- a selector for sub-dividing the signal from the filters regulated by synchronism signals from a synchronism signal generator,
- two peak meters arranged to receive the signals from the selector and to process them according to timing signals provided by the synchronism signal generator,
- an adder suitably synchronised by the synchronism signal generator
- a calculator, for example of the microprocessor type, for receiving the signal from the adder and comparing it with the predetermined permanently stored value, and
- a corrector for correcting the air/fuel ratio according to the indications provided by the calculator.

BASIC THEORY OF THE INVENTION

It is known that during running of an engine, each individual cylinder draws a certain quantity of air and fuel; the quantity of air is proportional to the pressure in the induction manifold.

More particularly, studies and tests on the applicants' bench have shown that there is a correlation between the pressure values detected by a pressure sensor arranged suitably in the induction manifold, and anomalous combustion phenomena due to incorrect air/fuel ratios.

In order to check the method set out, they experimented directly on a vehicle on a roller bed. By controlling, through a suitable electronic control unit, the quantity of fuel supplied at each phase, they subjected it to different air/fuel mixture ratios at constant revolutions, recording on a magnetic tape the output signal of a pressure transducer placed in communication with the induction manifold.

In particular, the pressure in the induction manifold was determined by the quantity of air trapped in the manifold under the suction effect of each cylinder.

The flow rate of air sucked in by each cylinder and flowing through the seat of the induction valve can be expressed by the function:

$$G=f(A, K, \rho, \Delta p, t_A)$$

where $G$=flow rate
$A$=valve area
$K$=specific calorie ratio Cp/Cr
$\rho$=density
$\Delta p$=pressure jump across the valve
$t_a$=open time The air flow rate depends on several parameters which are influenced by the fuel dispersion, which increases when the engine is supplied with a very lean mixture, causing instability.

The parameter $\Delta p$ is a function of the pressure in the cylinder in the induction phase, in its turn a function of the velocity of the piston which experiences all the variations in the conditions of rotation, even those caused by the cyclic combustion dispersion.

The anomalies in combustion cause a dispersion in the air flow rate and hence variations in the induction pressure which will thus be correlatable with the combustion dispersion.

DETAILED DESCRIPTION OF THE INVENTION

The invention will now be described, purely by way of non-limiting example, with reference to the appended drawings, in which.

For convenience, the elements of the illustrated drawings are indicated by the same reference numerals.

Figure 1:
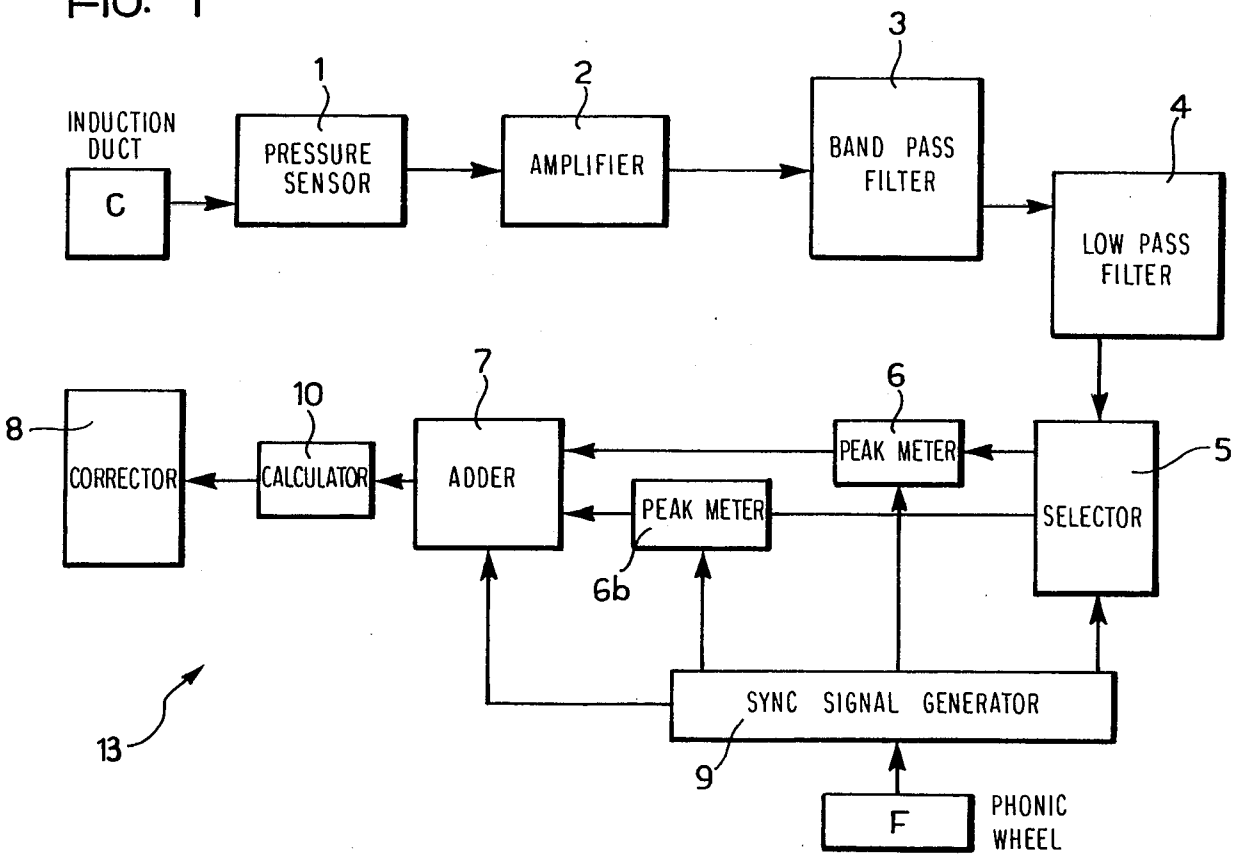
FIG. 1 is a schematic view of apparatus according to the invention.

Entering into more detail now and with reference to the appended drawings, in FIG. 1 the reference (C) indicates an induction duct of an internal combustion engine.

According to the invention, a pressure sensor (1) is arranged in communication with the induction duct for providing a pressure signal which is treated suitably by an amplifier (2), filtered by a band-pass filter (3) and subsequently by a low-pass filter (4).

A measurement channel selector indicated (5) subdivides the signal and directs it to two peak meters (6) and (6 bis).

A phonic wheel (F) is keyed onto the drive shaft so as to output a pulse every 180° synchronous with each upper dead point (top dead centre).

These pulses are directed to a synchronism signal generator (9).

A data adder is indicated (7). On the basis of the synchronism signals received from the generator (9) the adder (7) sums the indications of the peak meters (6) and (6 bis).

A microprocessor (10) stores a predetermined value of the air/fuel ratio. This value has previously been found by suitable bench rests on an engine and corresponds to the optimum metering value for every condition of engine operation, defined in terms of revolutions under load.

In use, the signal from the sensor (1) is sent to the selector (5) after being filtered by the filters (3) and (4); in particular, the filter (3) eliminates the harmonic components of frequencies less than 2 Hz and greater than 200 Hz, the maximum frequency value corresponds to that of the engine speed of 6,000 revolutions; the filter (4) eliminates the frequencies above the engine rotational speed, consequently varying the cut-off frequency in synchronism with the engine revolutions.

According to the invention, the selector (5) receives the signals from the pressure sensor (1) suitably filtered by the filters (3) and (4) and separates them, sub-dividing them for each engine phase, sending them then to the peak meters (6) and (6 bis). The sub-division of the signals is necessary to enable information to be provided which is as complete as possible.

The indications provided by the peak meters (6) and (6 bis) are serialised by means of the adder (7) which is suitably synchronised by the generator (9) and are then fed to the microprocessor (10) in which a predetermined value of the air/fuel ratio is stored. At the output of the data adder (7) there appear voltage levels proportional to the irregularities in the induction pressure of the engine and hence suitable for calculating the stability thereof.

From a comparison of the value detected and the value stored an indication is derived which is relevant to the state of operation of the engine and hence of a need to intervene, or not, in a closed loop to correct the metering, with the corrector (8).

Figure 2:
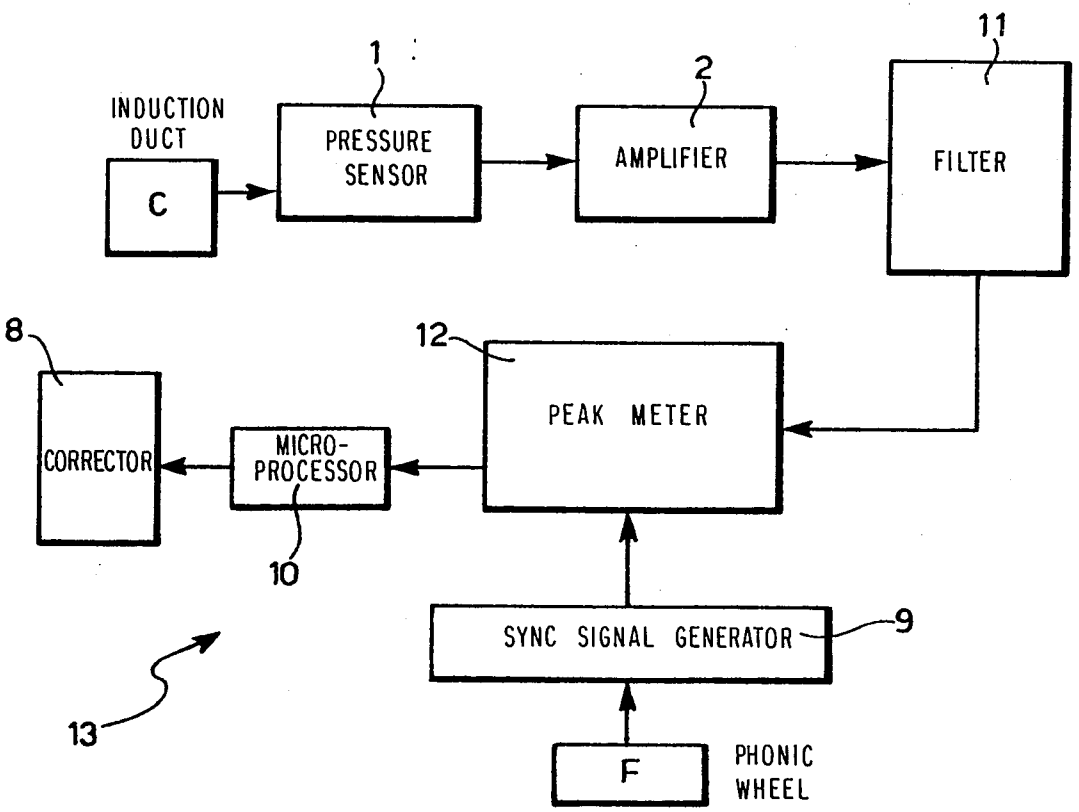
FIG. 2 illustrates a variant embodiment of the control apparatus illustrated in FIG. 1.

In the example illustrated in FIG. 2, the signal from the amplifier (2) is filtered by a single filter (11), this filter being arranged to fulfil the functions carried out by the filters (3) and (4) in the embodiment of FIG. 1.

According to the schematic illustration of FIG. 2, the signal filtered by the single filter (11) is sent directly to a single peak value meter (12), the selector (5) described in FIG. 1 no longer being necessary. The peak meter (12) will then process the signals from the generator (9), comparing them with the indications from the filter (11), and will send them to the microprocessor (10) which will send indications to the corrector (8).

The advantages of the present invention will be clear from what has been described.

It in fact allows the provision, in a simple and cheap manner, of a reliable operating device able to monitor and/or self-correct anomalies relative to the air/fuel ratio in an internal combustion engine. The technology used to carry out the invention is particularly economical and compatable with the requirements of current motor car production.

Finally from what has been described it is clear, that variants may be made to the device and to the method according to the present invention without departing from the scope of the invention itself.

We claim:

1. Method of monitoring anomalous combustion phenomena, particularly the air/fuel ratio during running of an internal combustion engine, characterised in that it comprises the steps of:

measuring the air pressure in the induction duct while the engine is running, processing the pressure signal in order to determine variations from one cycle to the next induced by anomalous combustion phenomena storing a predetermined value, corresponding to an optimum running value, indicating the presence of anomalous phenomena in the air/fuel ratio when the value corresponding to the pressure variation measured departs from the stored value, and correcting the air/fuel ratio.

2. A device for effecting the continuous monitoring of the exact air/fuel ratio in an endothermic engine, characterised in that it comprises:

a pressure sensor (1) located suitably in the engine induction duct, a signal amplifier (2) for amplifying the signal, a band-pass filter (3) and a low-pass filter (4) arranged to select a suitable frequency range for the signal, a selector (5) for sub-dividing the signal from the filters (3) and (4) and regulated by synchronism signals coming from a synchronism signal generator (9), two peak meters (6) and (6 bis) arranged to receive the signals from the selector (5) and to process them according to timing signals from the synchronism signal generator (9), an adder (7) suitably synchronised by the synchronism signal generator (9), a calculator (10), for example the of the microprocessor type, for receiving the signal from the adder (7) and comparing it with the predetermined permanently stored value, and a corrector (8) for correcting the air/fuel ratio according to the indications provided by the calculator (10).

3. A device according to claim 2, characterised in that it includes a signal-selective filter (11) for performing the band-pass and low-pass filtering functions.

4. Device according to claim 2, characterised in that it includes a single peak value meter (12).

* * * * *